US005086587A

United States Patent [19]

Andrews

[11] Patent Number: 5,086,587

[45] Date of Patent: Feb. 11, 1992

[54] BALANCED BEAM LATCHING APPARATUS

[76] Inventor: Zenas B. Andrews, P.O. Box 2536, Pascagoula, Miss. 39567

[21] Appl. No.: 647,987

[22] Filed: Jan. 30, 1991

[51] Int. Cl.[5] ..... E05C 9/00

[52] U.S. Cl. ..... 49/395; 292/48; 292/240

[58] Field of Search ..... 49/395; 114/117; 292/48, 29, 240, 241, 196

[56] References Cited

U.S. PATENT DOCUMENTS

| | | | |
|---|---|---|---|
| 2,156,635 | 5/1939 | Mascuch et al. | 114/117 |
| 2,179,495 | 11/1939 | Court et al. | 114/117 |
| 2,205,845 | 6/1940 | Cochran | 114/117 |
| 2,493,882 | 1/1950 | Lambert | 114/117 X |
| 2,493,980 | 1/1950 | Lambert | 114/117 X |
| 2,511,267 | 6/1950 | Jacob | 114/117 |
| 2,511,268 | 6/1950 | Schiff | 114/117 |
| 2,610,079 | 9/1952 | Lambert | 114/117 X |
| 3,362,573 | 1/1968 | Wales, Jr. | 114/117 X |
| 4,114,424 | 9/1978 | Johnson | 114/117 X |
| 4,803,808 | 2/1989 | Greisner | 49/395 X |

*Primary Examiner*—Philip C. Kannan
*Attorney, Agent, or Firm*—Rodger H. Flagg

[57] ABSTRACT

An adjustable, quick acting balanced beam latching apparatus for a fluid tight door, hatch or scuttle mounted in an aperture in a bulkhead, wall or deck onboard ships, aircraft and other liquid or gas tight structures. A box frame is secured in an aperture in the bulkhead, and a fluid tight door is pivotally secured to one side of the box frame by suitable door hinges. A plurality of rotating dogs are pivotally secured to retract within the box frame in the retracted position, and to extend through apertures in the box frame when in the extended position. A plurality of balanced beam linkage members are rotatably secured to the rotating dogs. A plurality of connecting rods are rotatably secured to the balanced beam linkage members, and to each other. An operating link is pivotally secured at one end to a central connecting rod, and pivotally secured at the opposite end to an operating crank arm which is secured through an aperture in the door frame. Inside and outside operating handles are secured to the crank arm, to form a quick acting latching apparatus. An annular gasket is secured to the inside of the fluid tight door, and an annular door stop has a gasket engaging edge position to form a fluid tight seal when the door is closed and one of the handles are positioned to seal the fluid tight door. Adjustable dog spindles serve to manually adjust the position of the rotating dogs, in relation to the engaged door wedges, from either side of the fluid tight door.

21 Claims, 6 Drawing Sheets

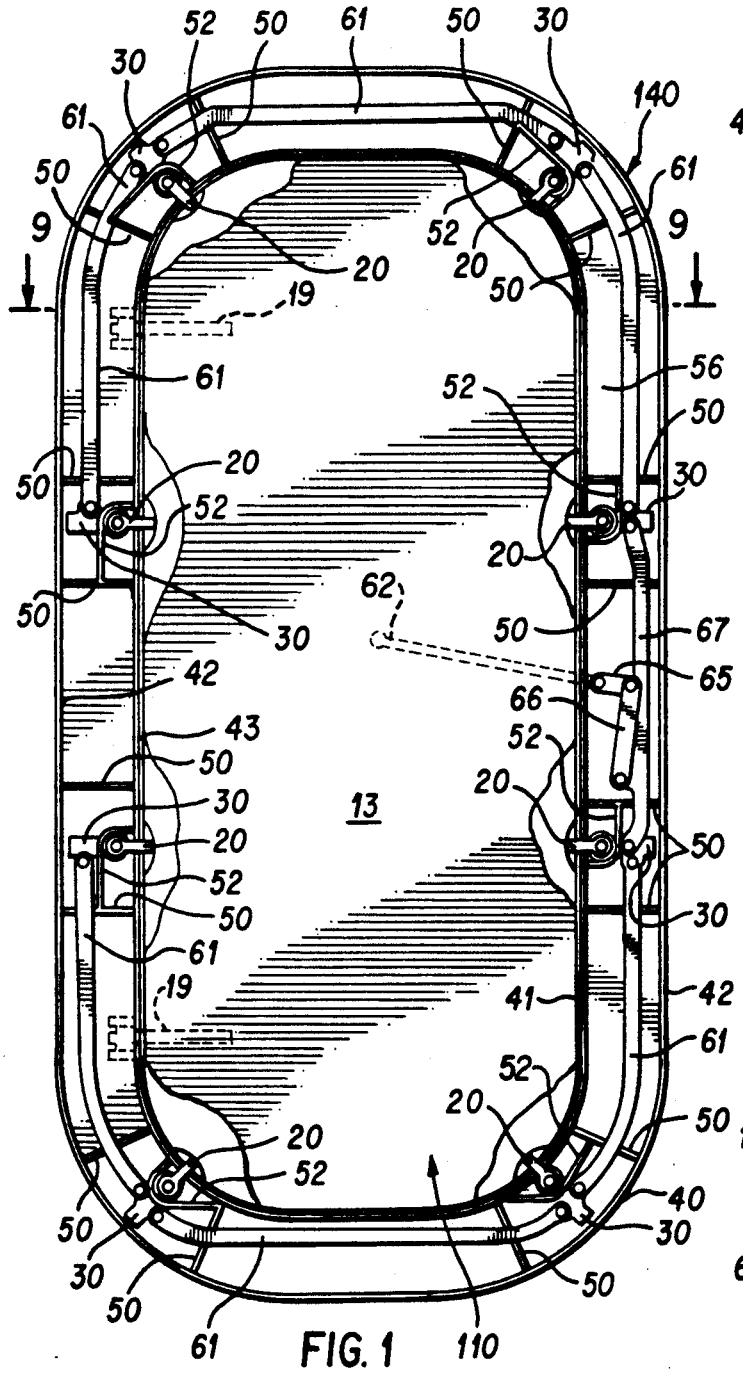
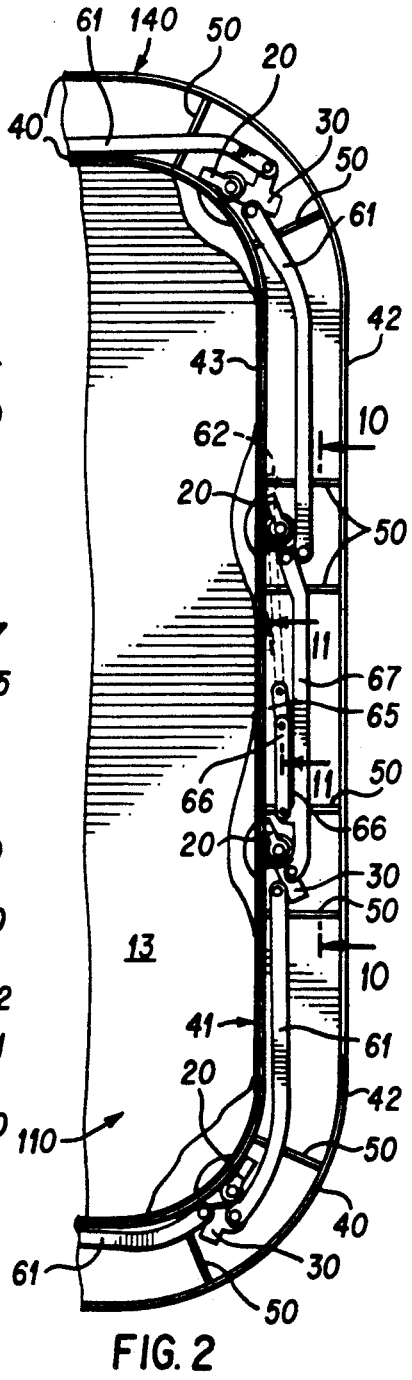
FIG. 2

BALANCED BEAM LATCHING APPARATUS

TECHNICAL FIELD

The present invention is directed to an adjustable, quickacting latching apparatus for a fluid tight door, hatch or scuttle mounted in an aperture in a bulkhead, wall or deck onboard ships, aircraft and other liquid or gas tight structures.

RELATED PRIOR ART

U.S. Pat. No. 4,114,424 issued Sept. 19, 1978 is representative of prior art disclosing a door mounted central actuating means.

U.S. Pat. No. 3,362,573 issued Jan. 9, 1968 discloses a quick release explosion-proof enclosure for electrical equipment.

U.S. Pat. No. 2,610,079 issued Sept. 9, 1952 discloses a dog spindle assembly for bulkhead doors.

U.S. Pat. No. 2,511,268 issued June 13, 1950 discloses a fastening means for bulkhead doors.

U.S. Pat. No. 2,511,267 issued June 13, 1950 relates to bulkhead door structure.

U.S. Pat. No. 2,493,980 issued June 13, 1950 discloses a handle retaining structure for bulkhead doors.

U.S. Pat. No. 2,493,882 issued Jan. 10, 1950 discloses a door latch structure for bulkhead doors.

U.S. Pat. No. 2,179,495 issued Nov. 14, 1939 discloses a door and hatch closure.

U.S. Pat. No. 2,156,635 issued May 2, 1939 discloses a bulkhead door having a corrugated core with a thin metal skin.

Together, these patents represent the most relevant prior art known to applicant relating to applicant's balanced beam latching apparatus.

DISCLOSURE OF THE INVENTION

This invention relates to a quick acting, adjustable fluid tight door, hatch or scuttle having a water tight or gas tight seal when closed. The fluid tight door with its surrounding box frame structure provides access through a bulkhead, wall or deck aboard ships, aircraft, or other liquid or gas tight structures. The fluid tight door of this invention utilizes a plurality of balanced beam dog latches which operate in unison for quick actuation when the door is manually latched or unlatched. Fluid tight doors are installed aboard ships to provide a fluid tight closure between a bulkhead to prevent flooding or gas leakage between adjacent compartments, or between the ships exterior and interior to restrict wind, rain or waves.

The fluid tight door of this invention is light in weight, quick acting, simple in construction, easy to operate manually, and provides uncluttered exterior surfaces. The balanced beam dog latching mechanism enables the user to quickly and easily adjust door gasket compression to maintain a fluid tight seal. The balanced beam configuration withstands the high shock of an internal or external explosion. All operating linkages are protected by the covered recess located in the box frame cavity.

The box frame surrounds the swinging fluid tight door and transmits bulkhead shear loads across the door opening, thereby reducing bulkhead framing. The fluid tight door and surrounding box frame assembly are simple to install and maintain, provide uncluttered exterior surfaces, and the dog latches retract within the box frame when the door is open. The balanced beam latching mechanism provides strength by design in order to resist high shock loads which may cause damage to the ship's bulkhead and door.

The forces acting against the rotating dogs on one side of the spindle are countered by a balanced force against the box frame on the opposite side of the spindle. This effectively reduces cantilever bending forces against the rotating dog spindle by providing offsetting loads at both ends of the balanced beam latching mechanism.

When the fluid tight door is unlatched, the rotating dogs retract into the box frame, eliminating protrusions which may obstruct passage through the fluid type door. When the fluid tight door is latched, each of the rotating dogs extend out of the box frame and rotate to engage a wedge mounted within the swinging door frame. The smooth open door frame interior surfaces prevent the snagging of clothes or hand carried objects when a user passes through an open door. Adjustment of the door latching mechanism varies the door gasket compression around the periphery of the door in order to provide a uniform, fluid seal entirely around the fluid tight door. This adjustment may be used to compensate for elastomeric creep or door and bulkhead warpage. The door latch adjustment permits unjamming of a warped, fluid tight door following an emergency, such as a fire or an explosion.

The box frame provides an intrinsically stiff structure which may replace structural bulkhead framing as a means of reinforcing the door opening in the bulkhead. The box frame and door assembly by configuration will not easily warp when welded into the bulkhead, and the box frame will resist warpage whenever the surrounding ship's bulkhead is deformed. All door linkages operate in unison, a quick acting feature, by means of interconnecting levers and linkages mounted within the box frame structure. These unique features thereby provide a high strength, lightweight door which is easy to operate. The door may be manually latched or unlatched by an operating handle located on the exterior, the interior, or both the exterior and interior sides of the box frame.

The door linkage mechanism comprises levers and rotating joints having a minimum number of parts. Bell cranks which are typically used in door corners to transfer vertical linkage motion into horizontal linkage motion are eliminated by the location of the connecting rod joints on the balance beams. Cover plates on the box frame prevent tampering, while the cover plates provide accessibility for ease of maintenance, enabling the rapid replacement or adjustment of damaged or warn parts.

The above mentioned and other features and objects of this invention and the manner of attaining them will become more apparent and the invention itself will be best understood by reference to the following description of an embodiment of the invention, when considered in conjunction with the accompanying drawings.

BRIEF DESCRIPTION OF THE DRAWINGS

FIG. 1 is a front view of the fluid tight door and surrounding box frame, with the rotating dogs shown in closed position, and with the box frame outside cover plates removed.

FIG. 2 is a partial view of the fluid type door shown in FIG. 1, with the rotating dogs rotated to the open position.

BEST MODE FOR CARRYING OUT THE INVENTION

Figure 3:
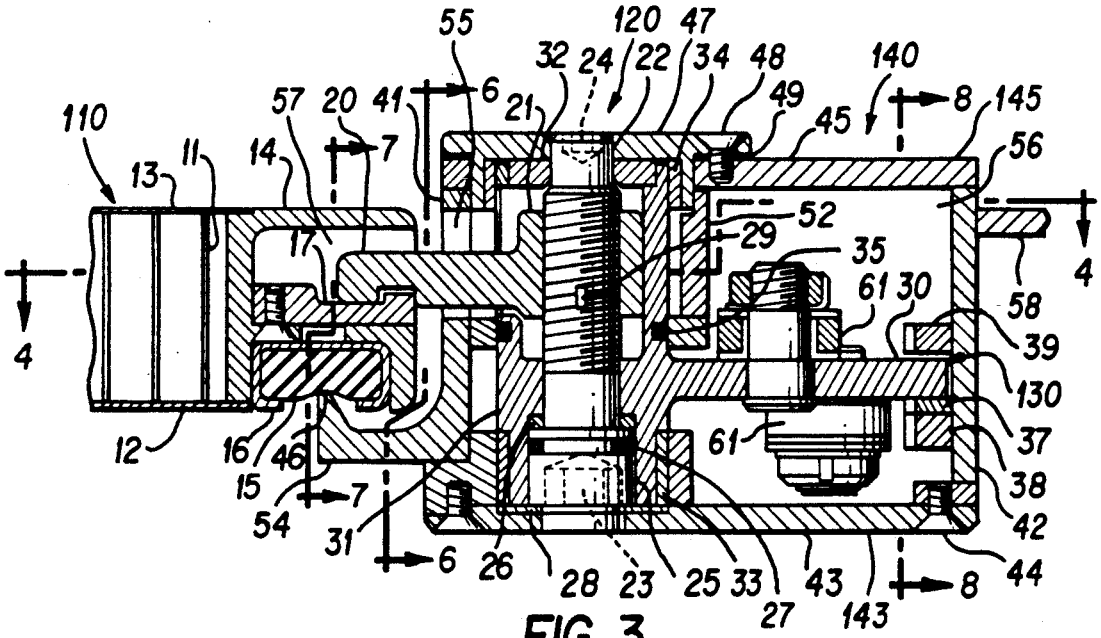
FIG. 3 is a sectional view of the balanced beam latching mechanism, taken along lines 3—3 in FIG. 4.
Figure 7:
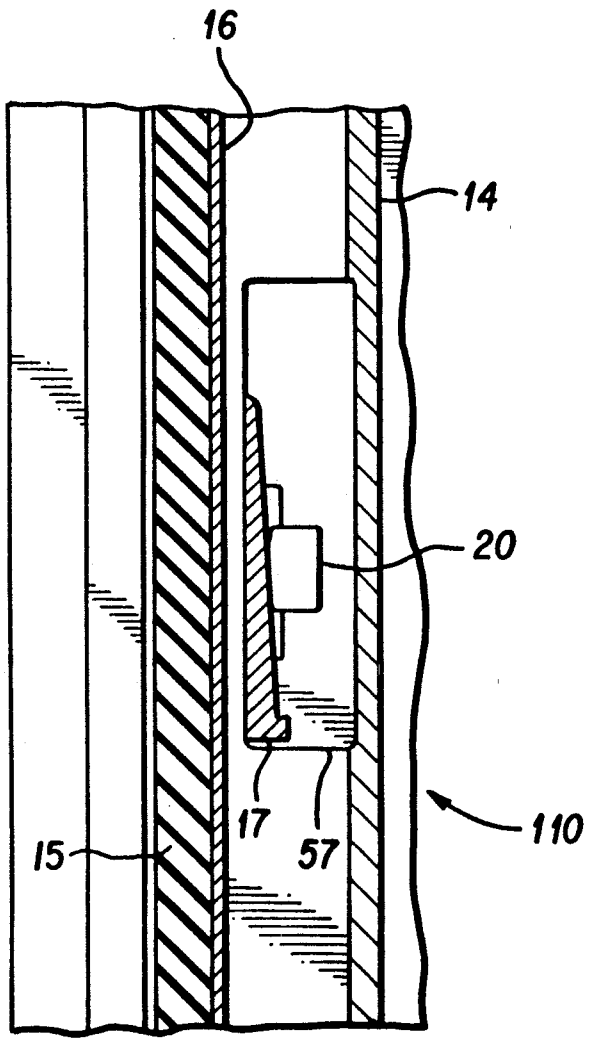
FIG. 7 is a sectional view taken along lines 7—7 in FIG. 3.
Figure 9:
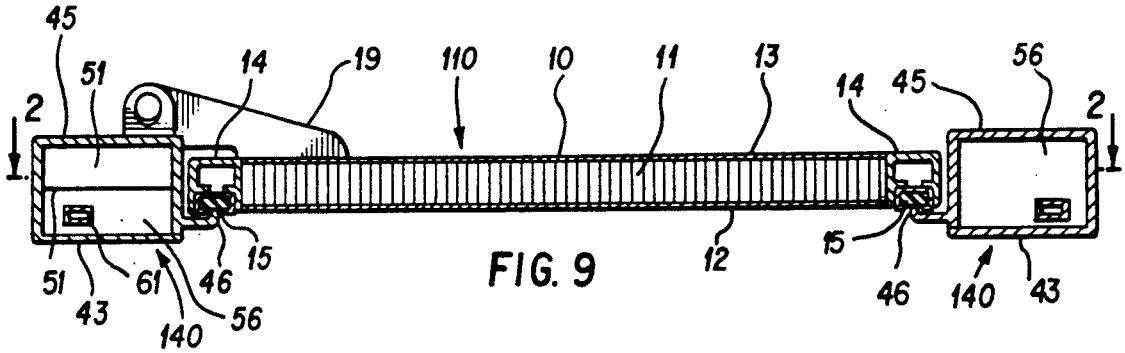
FIG. 9 is a sectional view taken along lines 9—9 in FIG. 1.

The subject matter which I regard as my invention is particularly pointed out and distinctly claimed in the claims. The structure and operation of my invention, together with further objects and advantages, may be better understood from the following description given in connection with the accompanying drawings, in which:

FIG. 1 is a front view of the box frame assembly 140 and the fluid tight door assembly 110, shown with the rotating door dogs 20 in their closed position. The balanced beam latching apparatus disclosed herein comprises two basic principal assemblies; the swinging fluid tight door assembly 110 and the box frame assembly 140. These two assemblies may be fitted together during manufacture, and welded into a suitable bulkhead 58 as a single unit. The swinging fluid tight door 10 comprises a central steel honeycomb core panel 11, with inside and outside face sheets 12, 13 and a door frame 14. The door frame 14 surrounds the periphery of the honeycomb core panel 11. An elastomer type door seal, or gasket 15 is mounted within the door frame 14 as shown in FIGS. 3, 7 and 9. Door wedges 17, are located under each rotating dog 20 at a plurality of locations around the periphery of the swinging door 10. Preferably there are eight rotating dogs 20 as shown in FIG. 1. The fluid tight door assembly 110 is hinged on the door hinge side to the box frame 40 by one or more hinges 19. The door opening side is opposite to the door hinge side, shown in FIG. 9.

Preferably, two hinges 19 are used to secure the door assembly 110 to the box frame assembly 140, as shown in FIGS. 1 and 9. An annular elastomeric door seal or gasket 15 surrounds the door 10 to provide a fluid tight seal, when the door assembly 110 is secured by the rotating dogs 20 to the box frame assembly 140. The annular gasket 15 is preferably mounted within the profile of the door frame 14 as shown in FIGS. 3 and 9.

A metal door gasket retainer 16 is preferably used to secure the door gasket 15 within door frame 14. Door wedges 17 are preferably made of bronze, and are preferably attached to the door frame 14 with screws 18. The door wedges 17 are positioned to engage the rotating dogs 20 at each of the plurality of locations about the periphery of the swinging watertight door 10.

Figure 4:
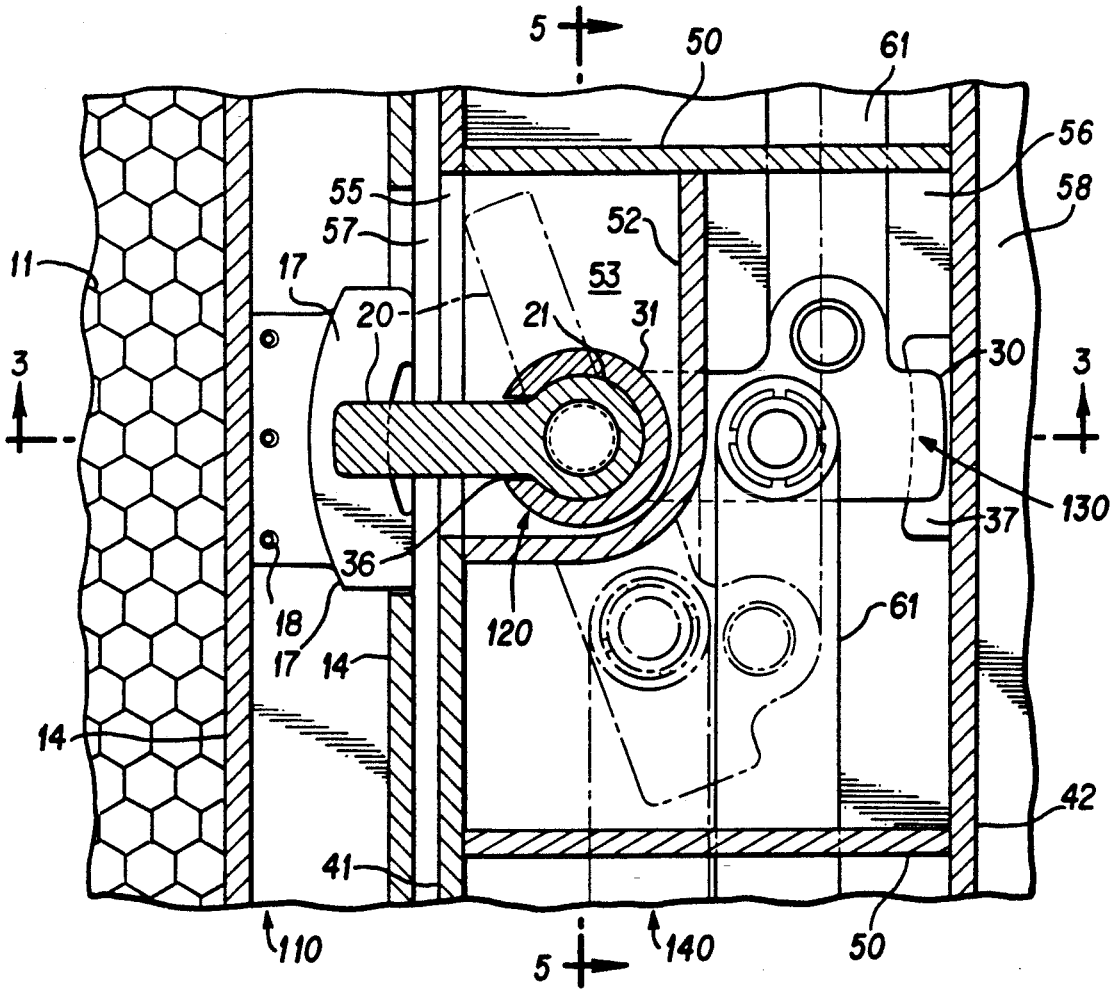
FIG. 4 is a sectional view of the latching mechanism taken along lines 4—4 in FIG. 3.

The rotating dog assembly 120 shown in FIG. 3 and 4 comprises a rotating dog 20; a spindle 22 threadably secured to the rotating dog 20. The spindle 22 has inside socket 23 and an outside socket 24 suitable for rotation by a hand tool such as a socket, allen wrench, or other hand tool (not shown). Spindle 22 preferably has an enlarged head portion 25 and a reduced inner sleeve portion 22.

The dog spindle head bearing 26 is preferably mounted on spindle 22 as shown in FIG. 3. The dog spindle inside thrust bearing 28 is mounted in a cavity of the box frame inside cover plate 143. The O-ring 27 provides a fluid tight seal to prevent fluid from passing between the inside and the outside of the bulkhead. A nylon thread lock 29 may be used to restrict rotation of dog 20 on spindle 22 due to vibration.

The balanced beam assembly 130 is best shown in FIGS. 3 and 4. The balance beam 30 has an outer sleeve 31 which rotates within box frame assembly 140. An outside thrust bearing 32 is retained within the outer end of balance beam 30. The outer end of balance beam 30 is rotatably secured by outside journal bearing 34. The inner end of balance beam 30 is rotatably secured by inside journal bearing 33.

An O-ring 35 restricts passage of fluid between inside and outside portions of the box frame assembly 140. As shown in FIG. 4, a key slot 36 engages the sides of rotating dog 20, to transfer torque from the outer sleeve 31 to the rotating dog 20. The unique feature of this concept is that torque is transferred from the outer sleeve 31 to the rotating dog 20, while axial thrust from adjustment of spindle 24 is not transferred from the outer sleeve 31 to the rotating dog 20. Inside and outside stops 38, 39 provide support for cantilevered forces acting on balance beam 30.

Figure 8:
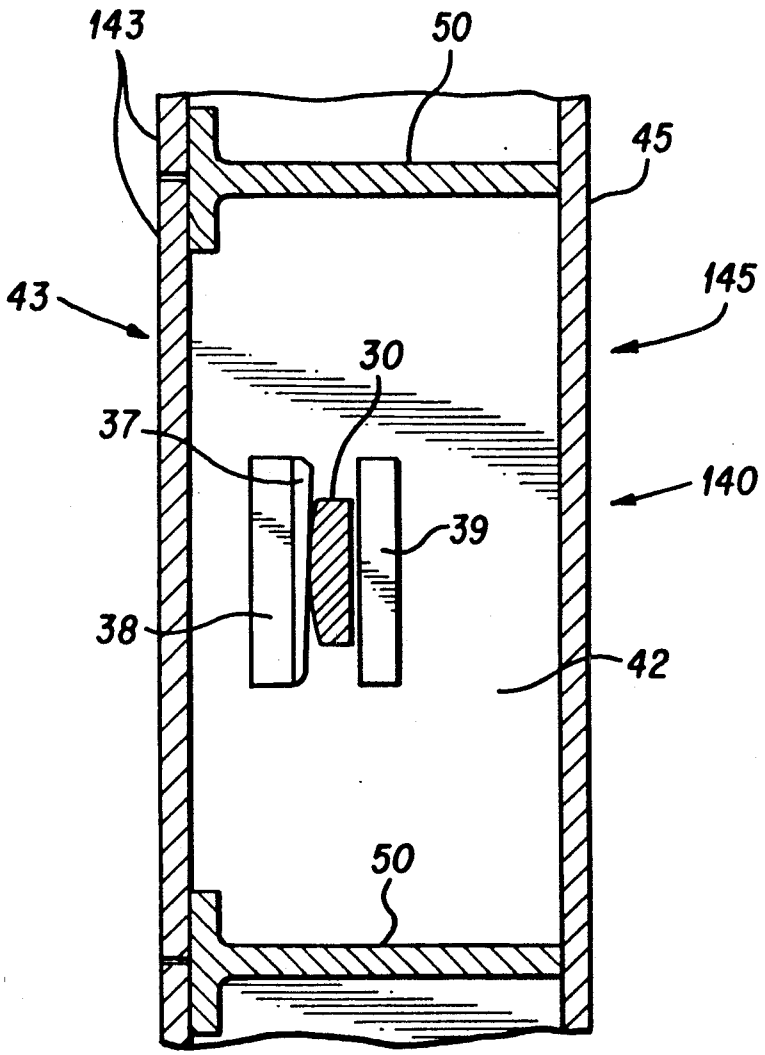
FIG. 8 is a sectional view taken along lines 8—8 in FIG. 3.

As shown in FIGS. 3 and 8, a wedge 37, preferably bronze, may be positioned between stops 38, 39 to provide more accurate positioning of stops 38 or 39, while allowing low friction rotational movement of balance beam 30 between stops 38, 39 and wedge 37. The box frame assembly 140 shown in FIGS. 1, 2, 3 and 4 surrounds the fluid tight door assembly 110 and serves as a surrounding door frame.

The box frame assembly 140 also serves as a structural member which transfers the ship's bulkhead 58 stresses across the door opening. This reduces the bulkhead framing required for conventional bulkhead door openings. The box frame structure 140 shown in FIGS. 1, 3, 4 and 5 comprises a door side 41 which is adjacent to the door frame 14 when the door is closed; a bulkhead side 42 which surrounds the box frame assembly 140 periphery; an outside 45; and an inside 43.

Figure 6:
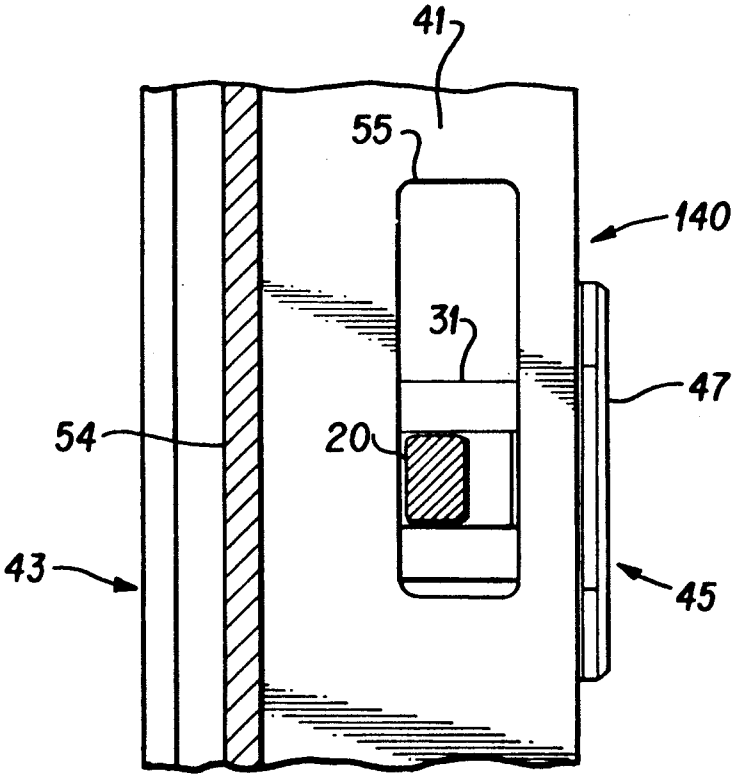
FIG. 6 is a sectional view taken along lines 6—6 in FIG. 3.

An annular door stop 46, shown in FIGS. 3 and 7, is secured to the box frame assembly 140 in proximity to the door side 41 of the box frame. The annular door stop 46 may be welded to the box frame assembly 140, or secured by conventional fasteners to suit manufacturing preference. The door side 41 of the box frame assembly 140 has a plurality of apertures 55 in the form of box frame dog openings, positioned in alignment with the rotating dogs 20. See FIGS. 3, 4 and 6. Apertures 55 allow the rotating dogs 20 to extend for latching the door 10 as shown in FIG. 1 or to retract for unlatching the door 10 as shown in FIG. 2.

The bulkhead side 42 of box frame 40 is a continuous solid plate that forms the exterior envelope of the box frame structure 40. The fluid tight door assembly 110 and the box frame assembly 140 may be welded as a one piece assembly into a suitable aperture 57 in the ship's bulkhead 58. Welding forms a fluid tight seal between the box frame 40 and the ship's bulkhead 58. The box frame structure 40 and the ship's bulkhead 58 form perpendicular joints, thereby minimizing warpage during welding. Inside cover plates 143 are preferably removable, and may be releasably secured to the box frame 40 with suitable fastening means, such as screws 44. Removal of inside cover plates 143 permits inspection and maintenance of rotating door dogs 20, connecting rods 61, associated operating linkage assemblies 60, and connecting rod joint assemblies 70.

A spindle cover plate 47 is preferably located over each rotating door dog 20. See FIGS. 3 and 5. The spindle cover plate 47 is preferably releasably secured to the box frame outside cover plate 145 with suitable fastening means, such as screws 48. A gasket 49 is preferably used to form a fluid tight seal between spindle cover plate 47 and box frame 40. Removal of the spindle cover plate 47 permits disassembly of the rotating door dog assembly 120 and the balance beam assembly 130 for repair or replacement.

The box frame structure 40 preferably includes webs 50 shown in FIGS. 1, 2, 4 and 5. Webs 50 provide additional structural strength and serve as fluid barriers on opposing sides of each rotating dog 20. Door hinge 19 reinforcing plates 51 may be used to reinforce each door hinge 19, as shown in FIG. 9. Box frame fluid barriers 52 form fluid barrier cavities 53, to prevent fluid passing from the outside of the door to the inside of the box frame. See FIG. 4.

Figure 5:
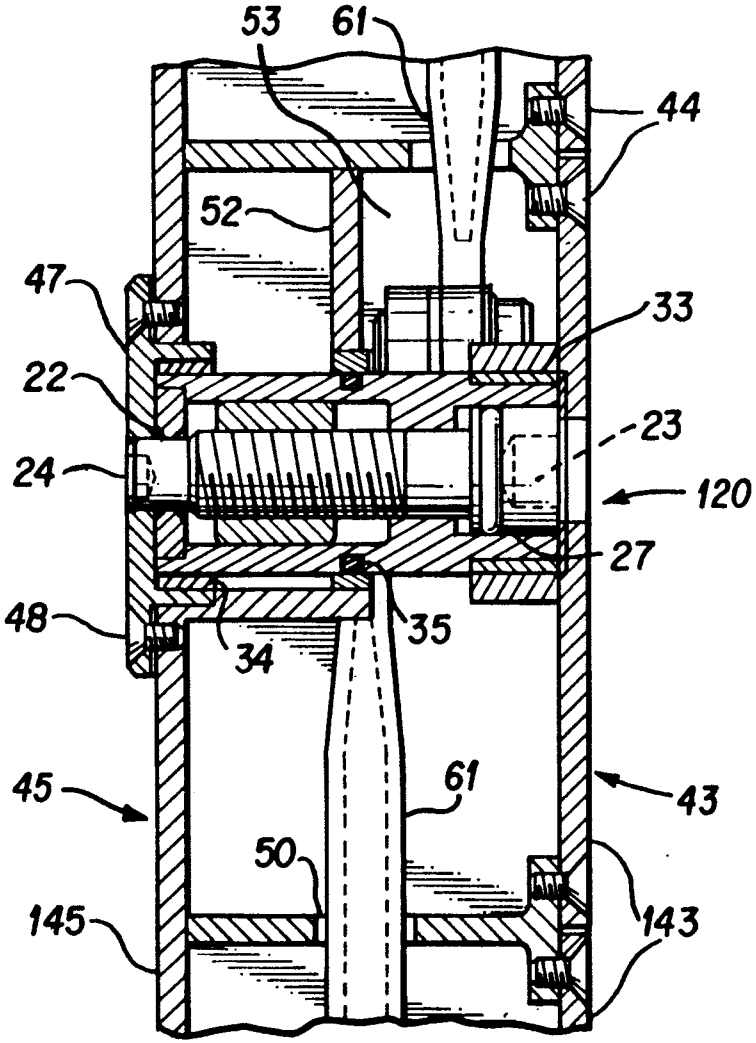
FIG. 5 is a sectional view of the rotating dog assembly located within the box frame, along lines 5—5 in FIG. 4.
Figure 10:
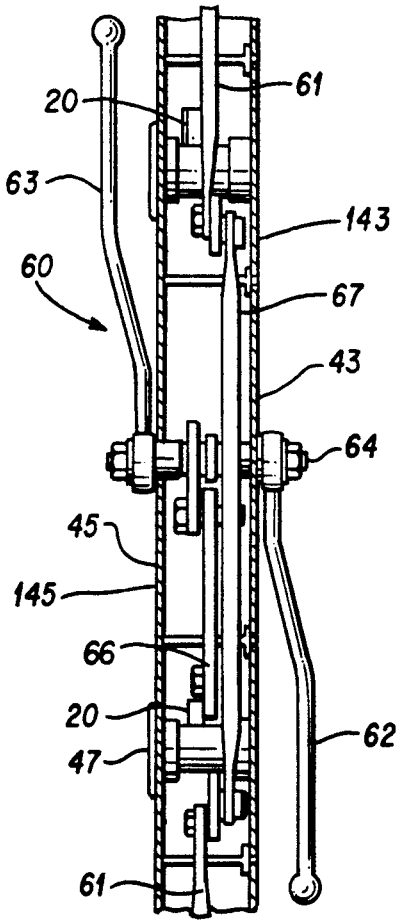
FIG. 10 is a sectional view taken along lines 10—10 in FIG. 2.
Figure 11:
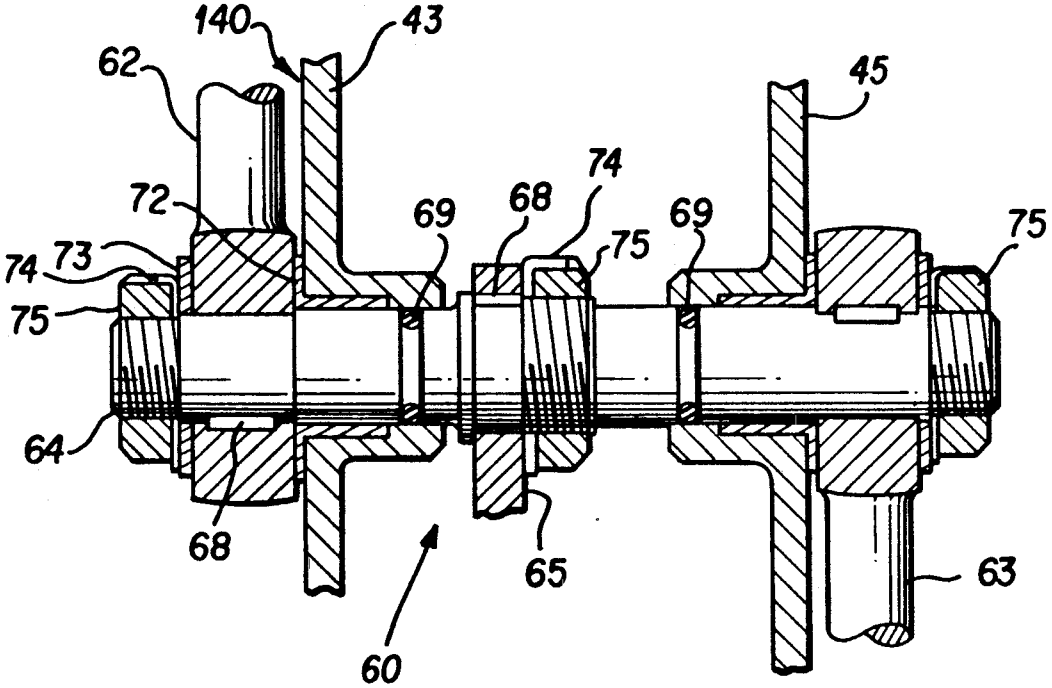
FIG. 11 is an enlarged sectional view of the operating handle shaft and handles shown in FIG. 10.

As shown in FIGS. 3 and 5, an O-ring seal 35 prevents fluid from passing through the outer sleeve 31 of the balance beam. The operating linkage assembly 60 provides quick-acting movement of each of the plurality of rotating dogs 20 between latching and unlatching positions. Connecting rods 61 are manually biased by outside operating handle 63 or by inside operating handle 62, as shown in FIG. 10. Inside and outside operating handles 62, 63 are keyed 68 to shaft 64 as shown in FIG. 11. O-rings 69 may be used to ensure a fluid tight seal between shaft 64 and the inside 43 and outside 45 of box frame 40.

The inside and outside operating handles 62, 63 are preferably rotatably positioned to extend beyond the profile of the fluid tight door 10 adjacent to the box frame 40 in the opened position, and rotatably positioned to extend within the profile of the fluid tight door 10 in the closed position.

An operating crank arm 65 is keyed 68 to shaft 64 to provide rotation of crank arm 65 and movement of the operating link 66. As shown in FIGS. 1 and 10, operating link 66 is connected to the middle of the central connecting rod 67. The central connecting rod 67 has joints at each end which are pivotally secured to balance beam joint 30 located above and below operating link 66 joints.

The central connecting rod 67 shown in FIG. 1 forms a linear motion linkage with the balance beam 30 and connecting rod joint assembly 70, to convert the rotary motion of handle shaft 64 into linear motion of the connecting rod 67. Each balance beam 30 has two joints. One joint accepts motion from connecting rod 60 and the other joint transmits motion to the next successive connecting rod 61.

Each balance beam 30 has two joints located in a different position as best shown in FIGS. 1 and 2. Each connecting rod 61 may be of a different length and shape to suit the positioning of rotating dogs 20 within the periphery of box frame assembly 140. Preferably, each rotating dog 20 rotates about 70 degrees between latching and unlatching positions.

The location of balance beam 30 joints within box frame structure 40 as shown in FIGS. 1 and 2, permit the conversion of connecting rod 60, 61 and 67 motion within the box frame cavity 56, between vertical and horizontal alignment, without requiring additional bell cranks at the interior corners of the box frame cavity 56.

Figure 12:
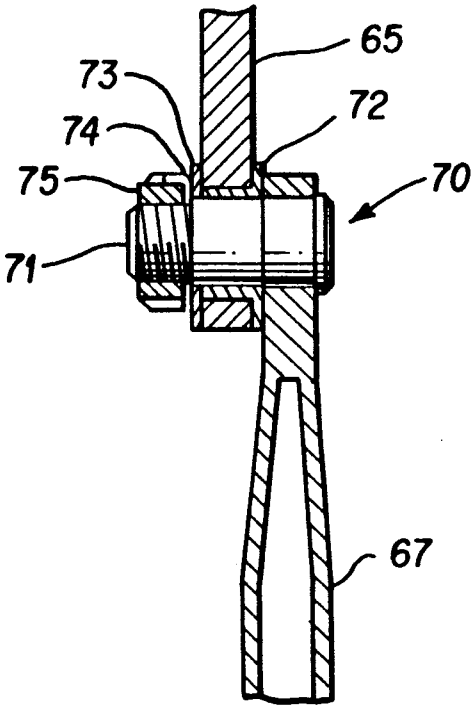
FIG. 12 is a sectional view of the operating crank arm connected to the central connecting rod shown in FIG. 10.

Each connecting rod joint assembly 70 shown in FIG. 12 provides low friction, minimizes lost motion or looseness, and enables the user to adjust alignment to compensate for wear over years of service. Journal bearing 72 and thrust washer 73 wear surfaces are preferably bronze, or may be coated with a layer of homogeneous composite matrix of a polymer resin interdispersed with polytetrafluoroethylene (TFE) to provide low friction and long wear characteristics.

The connecting rod joint assembly 70 preferably comprises a joint shaft 71, a flanged journal bearing 72, a thrust washer 73 and a star washer 74 and lock nut 75. Low friction wear surface coatings are preferably applied to the flanged journal bearings 72 and thrust washer 73. Star washer 74 and the milled slots in the ball bearing lock nut 75 provide incremental tightness adjustment to assure minimum looseness and low joint friction.

Each connecting rod 61 is preferably fabricated of square or round tubing to minimize weight, while providing stiffness for high-shock resistance, increased section moment-of-inertia, and improved strength-to-weight ratio.

While the preferred embodiment disclosed herein includes references to selected fastening means, such as bolts, nuts, washers, etc. it is within the scope of the present invention to use other known fastening means without departing from the spirit of the invention, of from the scope of the following claims.

INDUSTRIAL APPLICABILITY

This invention is intended for use as a fluid tight door mounted in an aperture in a bulkhead, which when opened permits passage of objects or people through the aperture; and when closed, provides a watertight or gas tight seal to restrict access of liquid or gas through the aperture. The disclosed invention is particularly useful for ships, aircraft, other vessels and between fluid tight compartments which may require a portion of the craft or compartment to be sealed off against intrusion of liquid or gas, while providing access through an aperture.

CONCLUSION

Although the present invention has been illustrated and described in connection with an example embodiment, it will be understood that this is illustrative of the invention, and it is by no means restrictive thereof. It is reasonably to be expected that those skilled in the art can make numerous revisions and additions to the invention and it is intended that such revisions and additions will be included within the scope of the following claims as equivalents of the invention.

I claim:

1. A latching apparatus for a fluid tight door, for mounting in an aperture in a bulkhead, which comprises:

a) a substantially enclosed box frame having a bulkhead side, an inside, an outside, and a door side; the bulkhead side of the box frame sized to be secured about the aperture in the bulkhead, the box frame having a plurality of latching apertures extending in spaced relation about the door side of the box frame;

b) a fluid tight door having an inside, an outside, a door hinge side and a door opening side, the fluid tight door positioned to be closely received within the door side of the box frame, and pivotally secured to the box frame by a suitable door hinge;

c) a plurality of rotating dogs, each pivotally secured in alignment with a selected latching aperture located in the door side of the box frame, the rotating dogs each positioned to retract within the box frame when in a retracted position, and to extend beyond the profile of the box frame to engage the outside of the fluid tight door when in an extended position;

d) a plurality of balanced beam linkage members secured by a slotted shaft to the rotating dogs within the box frame;

e) a plurality of connecting rods rotatably secured on opposite ends to adjacent balanced beam linkage members within the box frame, with a central connecting rod disposed within the box frame;

f) an operating link pivotally secured at one end to the central connecting rod;

g) an operating crank arm pivotally secured at one end to the opposite end of the operating link;

h) the opposite end of the operating crank arm pivotally secured to a shaft extending through an aperture in the door frame to inside and outside operating handles, the inside and outside operating handles rotatably positioned to extend beyond the profile of the fluid tight door adjacent to the box frame in the opened position, and rotatably positioned to extend within the profile of the fluid tight door in the closed position;

i) an annular gasket secured to the inside of the fluid tight door;

j) an annular door stop secured in proximity to the door side of the box frame, the door stop having an annular narrow gasket engaging edge positioned to abut the annular gasket on the fluid tight door when the fluid tight door is in a closed position; and k) a dog spindle threadably positioned within the box frame to provide axial alignment of the dog spindle towards the inside and outside of the box frame by rotation of the dog spindle from an external location selected from the inside and outside of the box frame, wherein the torque from rotation of the slotted shaft is transmitted to the rotating dogs, independently of the axial alignment of the dog spindle within the slotted sleeve.

2. The apparatus of claim 1, wherein the fluid tight door comprises a central honeycomb core, with inner and outer face sheets secured thereto, and an annular door frame extending about the central honeycomb core, the annular door frame sized to be closely received within the door side of the box frame member.

3. The apparatus of claim 2, wherein the inner and outer face sheets are secured to the honeycomb core of the fluid tight door, and the inside and outside portions of the box frame provide a spaced double wall to reduce heat transfer, and to improve protection against penetration by ballistic fragmentation.

4. The apparatus of claim 2, wherein an inclined door wedge is secured within the annular door frame to abut each rotating dog as the rotating dog is biased towards the closed position, to bias the door frame gasket against the engaging edge of the door stop.

5. The apparatus of claim 1, wherein a plurality of bulkhead wedge supports are secured within the box frame to the bulkhead side in close proximity to the inside and outside of each balanced beam linkage member, to support the balanced beam linkage against a shock load against the inside or the outside of the fluid tight door.

6. The apparatus of claim 1, wherein the box frame is positioned with the bulkhead side of the box frame within the aperture in the bulkhead, and welded to the bulkhead to secure the box frame in the aperture.

7. The apparatus of claim 1, wherein the dog spindle is adjustably positioned within the box frame by a tool which is removably engaged with the dog spindle from either the inside or outside the box frame.

8. The apparatus of claim 1, wherein the dog spindle is rotatably secured and adjustably positioned within the box frame by an outer sleeve which is sealed to provide a fluid tight barrier between the inside and the outside of the door frame.

9. The apparatus of claim 1, wherein a fluid barrier is disposed in the box frame about each of the rotating dogs to restrict the passage of fluid from the outside to the inside of the box frame.

10. The apparatus of claim 9, wherein a plurality of box frame webs are secured within the box frame in a spaced relation adjacent to each rotating dog for additional box frame strength.

11. A latching apparatus for a fluid tight door, for mounting in an aperture in a bulkhead, which comprises:

a) a substantially enclosed box frame having a bulkhead side, an inside, an outside, and a door side; the bulkhead side of the box frame sized to be closely received in the aperture in the bulkhead, the box frame having a plurality of latching apertures extending in spaced relation about the door side of the box frame;

b) a fluid tight door having an inside, an outside, a door hinge side and a door opening side, the fluid tight door positioned to be closely received within the door side of the box frame, and pivotally secured to the box frame by a suitable door hinge, the fluid tight door having a central honeycomb core, with inner and outer face sheets secured thereto, and an annular door frame extending about the central honeycomb core;

c) a plurality of rotating dogs, each pivotally secured in alignment with a selected latching aperture located in the door side of the box frame, the rotating dogs each positioned to retract within the box frame when in a retracted position, and to extend beyond the profile of the box frame to engage the fluid tight door when in an extended position;

d) a plurality of balanced beam linkage members, each secured by a slotted sleeve to one of the rotating dogs disposed within the box frame;

e) a plurality of connecting rods rotatably secured on opposite ends to adjacent balanced beam linkage members within the box frame, with a central connecting rod disposed within the box frame;

f) an operating link pivotally secured at one end to the central connecting rod;

g) an operating crank arm pivotally secured at one end to the opposite end of the operating link;

h) the opposite end of the operating crank arm pivotally secured to a shaft extending through an aperture in the box frame for securement to inside and outside operating handles, the inside and outside operating handles rotatably positioned to extend beyond the profile of the fluid tight door adjacent to the box frame in the opened position, and rotatably positioned to extend within the profile of the fluid tight door in the closed position;

i) an annular gasket secured to the inside of the fluid tight door;

j) an annular door stop secured in proximity to the door side of the box frame, the door stop having an annular narrow gasket engaging edge positioned to abut the annular gasket on the fluid tight door when the fluid tight door is in a closed position;

k) a plurality of inclined door wedges secured within the annular door frame to abut each rotating dog as the rotating dog is biased towards the closed position, to bias the door frame gasket against the engaging edge of the door stop; and l) a dog spindle threadably positioned within the slotted sleeve to adjustably position the rotating dogs in axial alignment toward the inside of the box frame and toward the outside of the box frame, by rotation of the dog spindle from an external location selected from the inside and outside of the box frame, wherein torque is transferred from the balanced beam members through the slotted sleeve to the rotating dogs, independent of the axial alignment of the dog spindle within the slotted sleeve.

12. The apparatus of claim 11, wherein a plurality of bulkhead wedge supports are secured within the box frame in close proximity to the inside and outside of each balanced beam linkage member, to support the balanced beam linkage against a shock load against the inside or the outside of the fluid tight door.

13. The apparatus of claim 11, wherein the box frame is positioned with the bulkhead side of the box frame within the aperture in the bulkhead, and welded to the bulkhead to secure the box frame in the aperture.

14. The apparatus of claim 11, wherein the dog spindle is adjustably positioned within the box frame by a tool which is removably engaged with the dog spindle from either inside or outside the door frame.

15. The apparatus of claim 11, wherein the dog spindle is rotatably secured and adjustably positioned within the box frame by an outer sleeve which is sealed to provide a fluid tight barrier between the inside and the outside of the door frame.

16. The apparatus of claim 11, wherein a fluid barrier is disposed in the box frame about each of the rotating dogs to restrict the passage of fluid from the outside into the box frame.

17. The apparatus of claim 16, wherein a plurality of box frame webs are secured within the box frame in a spaced relation adjacent to each rotating dog for additional box frame strength.

18. A latching apparatus for a fluidtight door, for mounting in an aperture in a bulkhead, which comprises:

a) a substantially enclosed box frame having a bulkhead side, an inside, an outside, and a door side; the bulkhead side of the box frame sized to be closely received in the aperture in the bulkhead, the box frame having a plurality of latching apertures extending in spaced relation about the door side of the box frame;

b) a fluid tight door having an inside, an outside, a door hinge side and a door opening side, the fluid tight door positioned to be closely received within the door side of the box frame, and pivotally secured to the box frame by a suitable door hinge, the fluid tight door having a central honeycomb core, with inner and outer face sheets secured thereto, and an annular door frame extending about the central honeycomb core;

c) a plurality of rotating dogs, each pivotally secured in alignment with a selected latching aperture located in the door side of the box frame, the rotating dogs each positioned to retract within the box frame when in a retracted position, and to extend beyond the profile of the box frame to engage the fluid tight door when in an extended position;

d) a plurality of balanced beam linkage members rotatably secured by a slotted sleeve to the rotating dogs within the box frame;

e) a plurality of bulkhead wedge supports secured within the box frame in close proximity to the inside and outside of each balanced beam linkage member, to support the balanced beam linkage against a shock load;

f) a plurality of connecting rods rotatably secured on opposite ends to adjacent balanced beam linkage members within the box frame, with a central connecting rod disposed within the box frame;

g) an operating link pivotally secured at one end to the central connecting rod;

h) an operating crank arm pivotally secured at one end to the opposite end of the operating link;

i) the opposite end of the operating crank arm pivotally secured to a shaft extending through an aperture in the box frame to inside and outside operating handles, the inside and outside operating handles rotatably positioned to extend beyond the profile of the fluid tight door adjacent to the box frame in the opened position, and rotatably positioned to extend within the profile of the fluid tight door in the closed position;

j) an annular gasket secured to the inside of the fluid tight door;

k) an annular door stop secured in proximity to the door side of the box frame, the door stop having an annular narrow gasket engaging edge positioned to abut the annular gasket on the fluid tight door when the fluid tight door is in a closed position;

l) a plurality of inclined door wedges secured within the annular door frame to abut each rotating dog as the rotating dog is biased towards the closed position, to bias the door frame gasket against the engaging edge of the door stop; and m) a a plurality of dog spindles, each dog spindle threadably positioned within the box frame to provide axial adjustment for a respective one of the rotating dogs within the latching aperture toward the inside or outside of the box frame, by rotation of the dog spindle with a hand tool from a selected external location on either the inside or the outside of the box frame; wherein torque from rotation of the slotted sleeve is transferred to the rotating dogs, independent of the axial adjustment position of the dog spindle.

19. The apparatus of claim 18, wherein the box frame is positioned with the bulkhead side of the box frame within the aperture in the bulkhead, and welded to the bulkhead to secure the box frame in the aperture.

20. The apparatus of claim 18, wherein a fluid barrier is disposed in the box frame about each of the rotating dogs to restrict the passage of fluid into the box frame.

21. The apparatus of claim 18, wherein a plurality of box frame webs are secured within the box frame in a spaced relation adjacent to each rotating dog for additional box frame strength.

* * * * *